US011358789B2

(12) United States Patent
Goines, Jr.

(10) Patent No.: US 11,358,789 B2
(45) Date of Patent: Jun. 14, 2022

(54) AIR FLOWING GARBAGE CAN ASSEMBLY

(71) Applicant: John Goines, Jr., Blue Ridge, TX (US)

(72) Inventor: John Goines, Jr., Blue Ridge, TX (US)

( * ) Notice: Subject to any disclaimer, the term of this patent is extended or adjusted under 35 U.S.C. 154(b) by 149 days.

(21) Appl. No.: 16/776,132

(22) Filed: Jan. 29, 2020

(65) Prior Publication Data

US 2021/0229903 A1 Jul. 29, 2021

(51) Int. Cl.
*B65F 1/06* (2006.01)

(52) U.S. Cl.
CPC ..... *B65F 1/068* (2013.01); *B65F 2210/1815* (2013.01)

(58) Field of Classification Search
CPC ..... B65F 1/068; B65F 2210/1815
USPC ..... 220/495.04
See application file for complete search history.

(56) References Cited

U.S. PATENT DOCUMENTS

| | | | | |
|---|---|---|---|---|
| 4,294,379 | A * | 10/1981 | Bard | B65F 1/068 220/495.04 |
| 5,375,732 | A | 12/1994 | Bowers | |
| 6,015,063 | A | 1/2000 | Poliquin | |
| 6,594,876 | B1 | 7/2003 | Stastny | |
| 6,736,281 | B2 | 5/2004 | Joseph | |
| 7,438,199 | B1 * | 10/2008 | Tidrick | B65F 1/06 220/495.04 |
| 8,418,873 | B2 | 4/2013 | Kastner | |
| 10,167,139 | B2 | 1/2019 | Frederick | |
| 2009/0095755 | A1 * | 4/2009 | McCurry | B65F 1/06 220/495.04 |

* cited by examiner

*Primary Examiner* — Stephen J Castellano

(57) ABSTRACT

An air flowing garbage can assembly for includes a garbage can that has a garbage bag being removably positioned therein to store garbage. The garbage can has a plurality of air holes integrated into the garbage can to pass air into an interior of the garbage can. A plurality of conduits is each coupled to the garbage can and each of the conduits is positioned in an interior of the garbage can. Each of the conduits is in fluid communication with a respective one of the air holes in the garbage can. In this way each of the conduits ventilates the interior of the garbage can when the garbage bag is removed from the garbage can thereby inhibiting a vacuum from forming in the garbage can.

4 Claims, 5 Drawing Sheets

AIR FLOWING GARBAGE CAN ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to air flowing devices and more particularly pertains to a new air flowing device for inhibiting a vacuum from forming in a garbage can when a garbage bag is removed from the garbage can.

(2) Description of Related Art Including Information Disclosed Under 37 CFR 1.97 and 1.98

The prior art relates to air flowing devices. The prior art discloses a garbage can that includes an air conduit that extends through a top edge of the garbage can for ventilating an interior of the garbage can. The prior art discloses a conduit that is removably insertable into a garbage can to ventilate an interior of the garbage can. Additionally, the prior art discloses a method of ventilating a garbage can which includes drilling holes in to the garbage can an extending a hose through the hose for ventilating an interior of the garbage can. The prior art also discloses a garbage can that has air channels integrated into an outer wall of the garbage can to inhibit a vacuum seal from forming between the garbage can and a garbage bag.

BRIEF SUMMARY OF THE INVENTION

An embodiment of the disclosure meets the needs presented above by generally comprising a garbage can that has a garbage bag being removably positioned therein to store garbage. The garbage can has a plurality of air holes integrated into the garbage can to pass air into an interior of the garbage can. A plurality of conduits is each coupled to the garbage can and each of the conduits is positioned in an interior of the garbage can. Each of the conduits is in fluid communication with a respective one of the air holes in the garbage can. In this way each of the conduits ventilates the interior of the garbage can when the garbage bag is removed from the garbage can thereby inhibiting a vacuum from forming in the garbage can.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
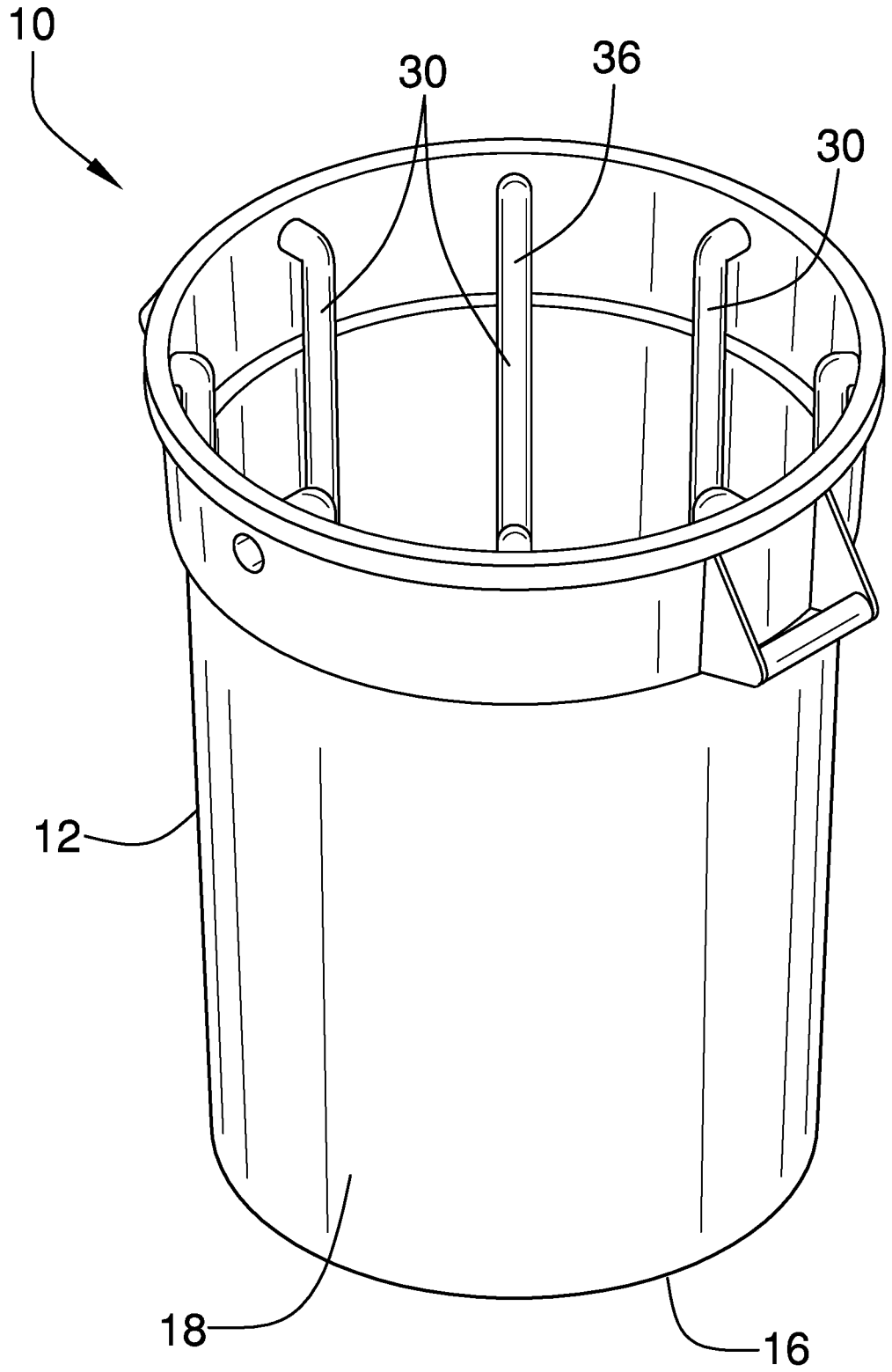
FIG. 1 is a top perspective view of an air flowing garbage can assembly according to an embodiment of the disclosure.
Figure 2:
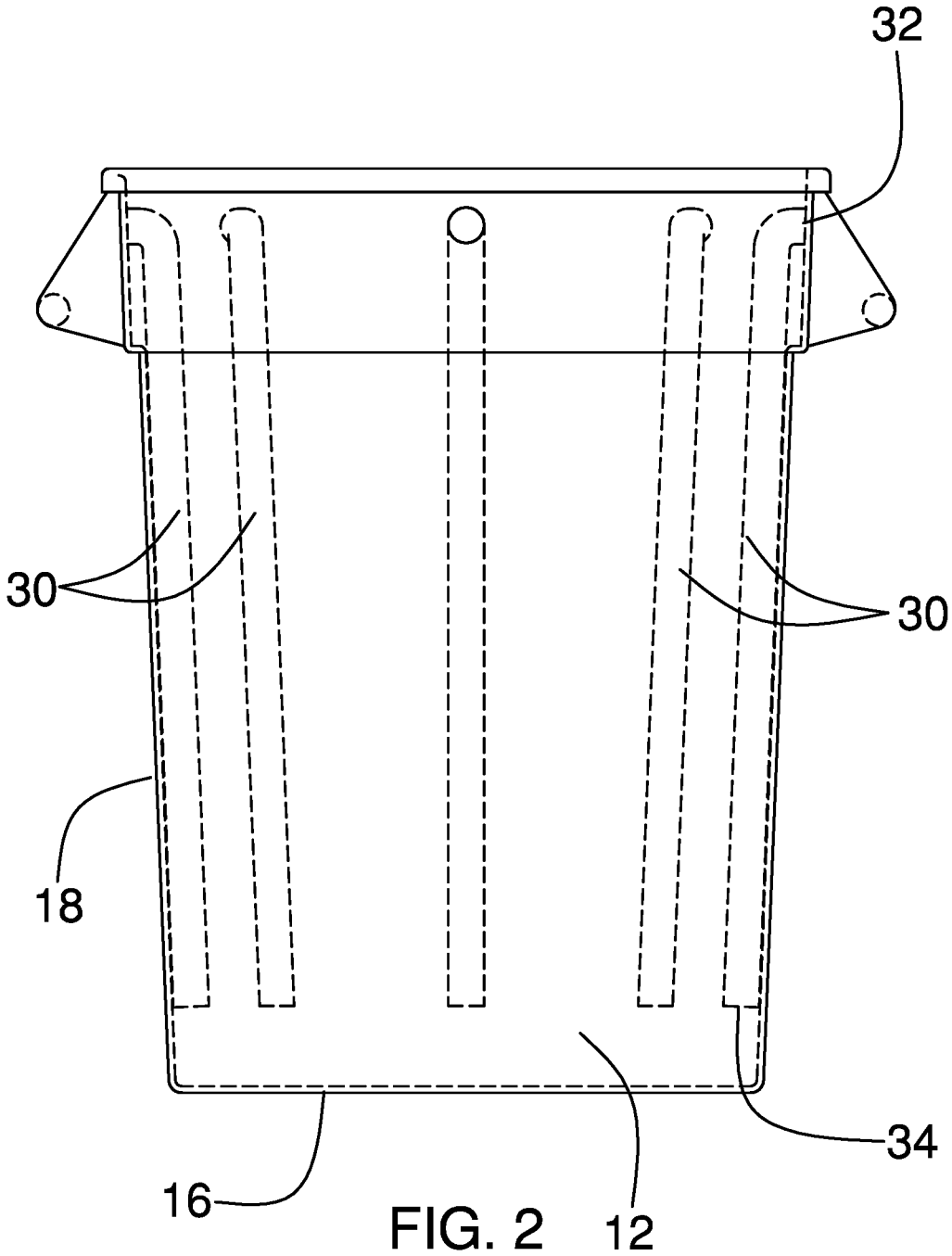
FIG. 2 is a front phantom view of an embodiment of the disclosure.
Figure 3:
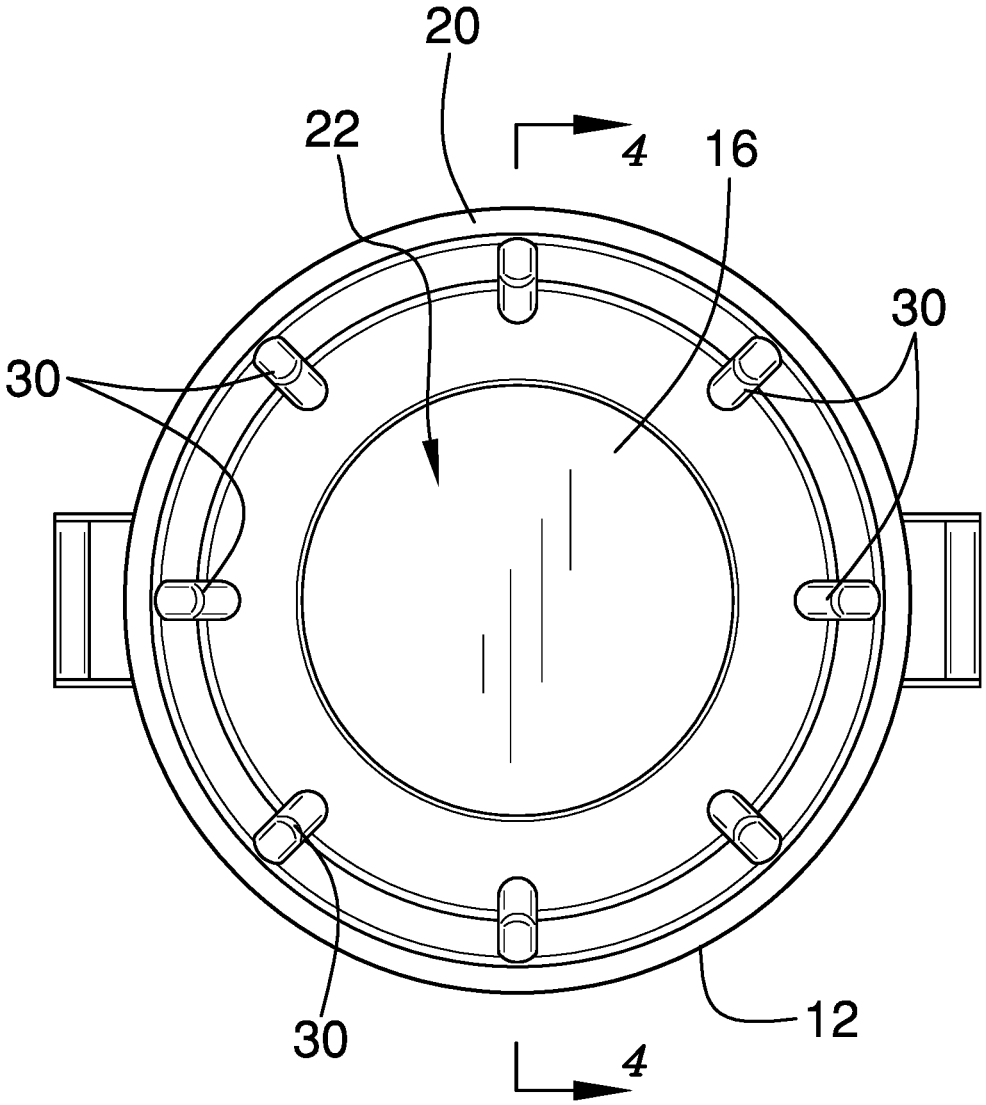
FIG. 3 is a top view of an embodiment of the disclosure.
Figure 4:
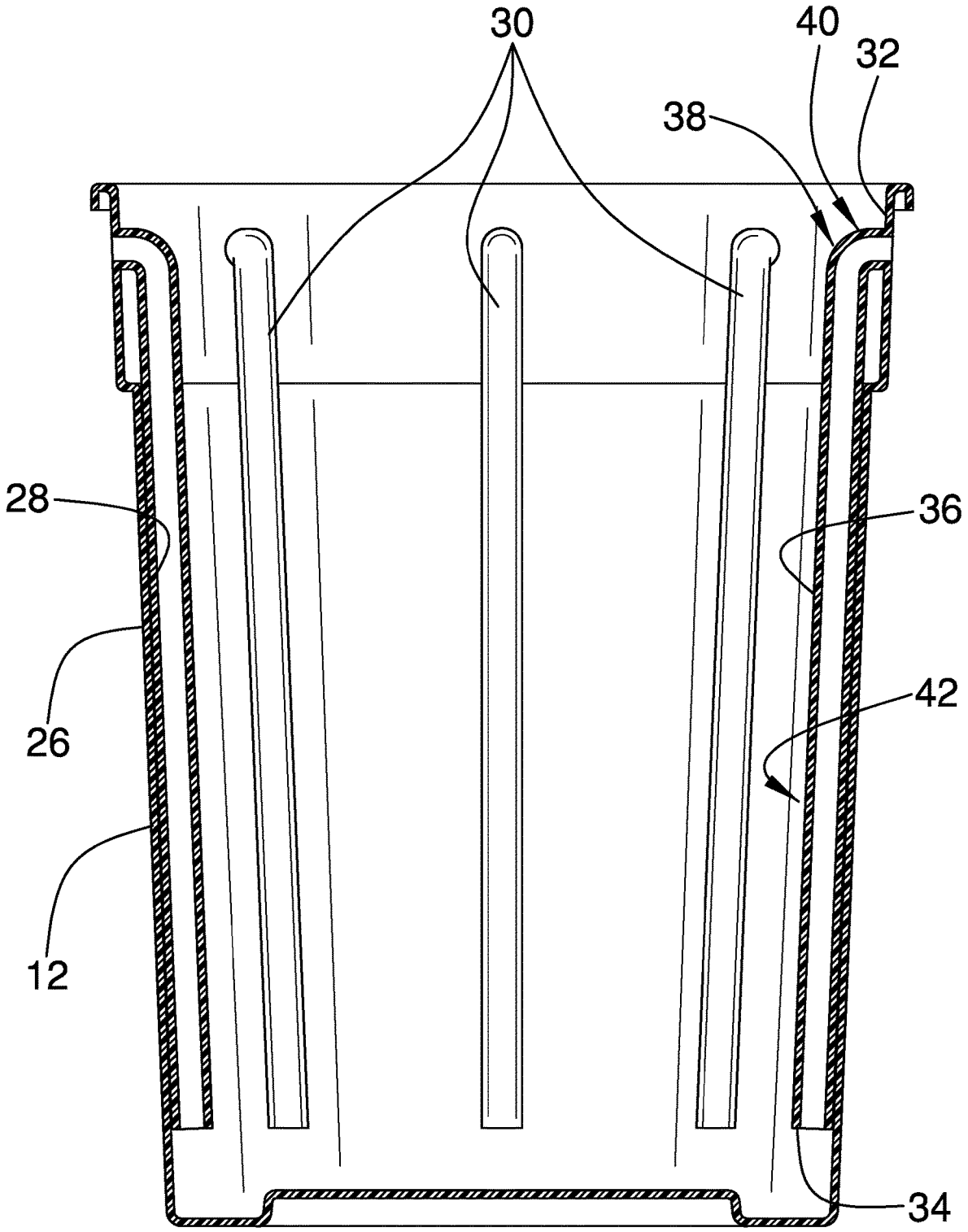
FIG. 4 is a cross sectional view taken along line 4-4 of FIG. 3 of an embodiment of the disclosure.
Figure 5:
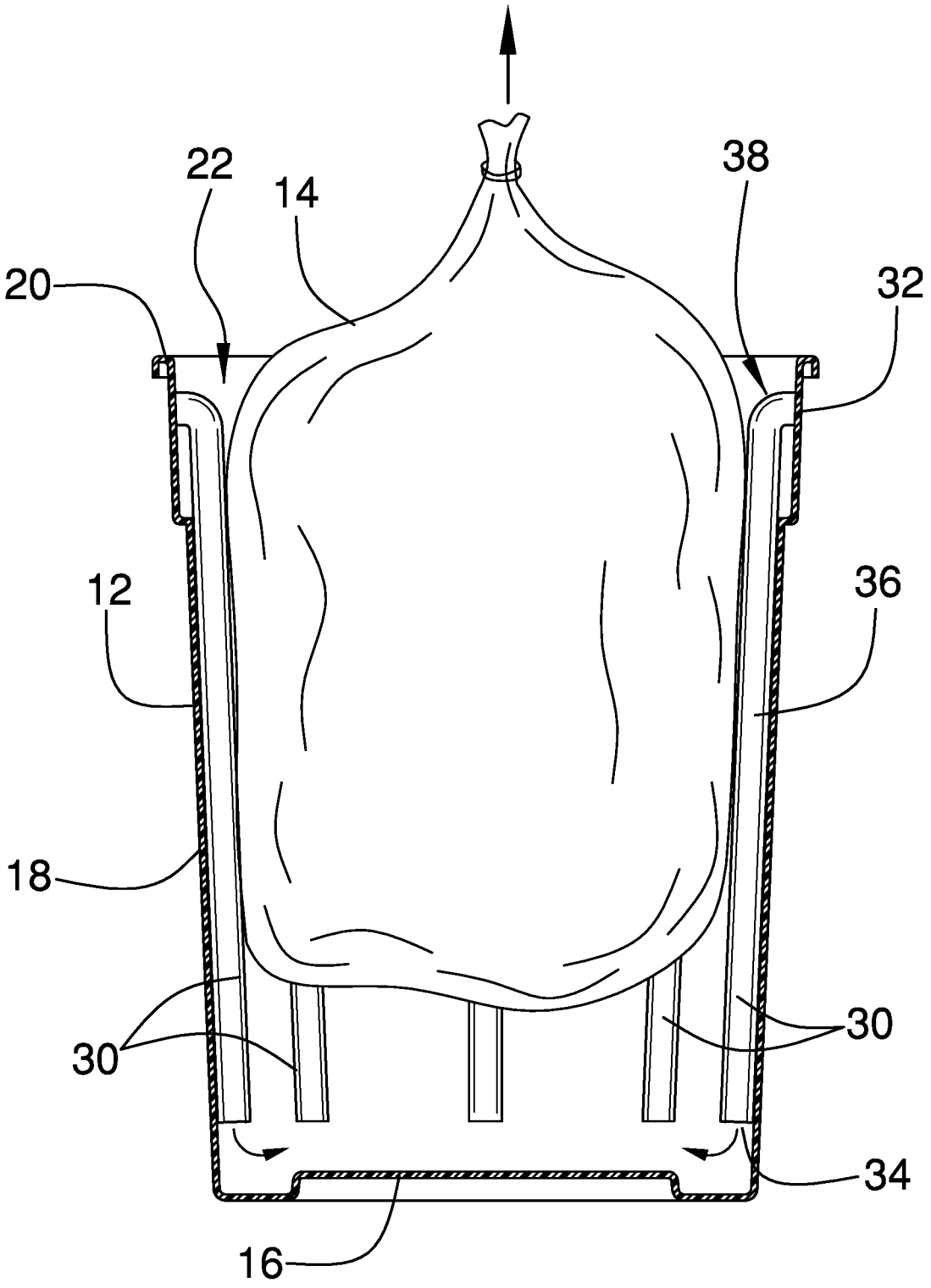
FIG. 5 is a cut-away in-use view of an embodiment of the disclosure.

With reference now to the drawings, and in particular to FIGS. 1 through 5 thereof, a new air flowing device embodying the principles and concepts of an embodiment of the disclosure and generally designated by the reference numeral 10 will be described.

As best illustrated in FIGS. 1 through 5, the air flowing garbage can assembly 10 generally comprises a garbage can 12. The garbage can 12 may be a kitchen garbage can, a yard garbage can or any other type of garbage can. Additionally, the garbage can 12 may be comprised of plastic, metal or any other type of material commonly associated with garbage cans. A garbage bag 14 is removably positionable in the garbage to store garbage. The garbage bag 14 may be a plastic garbage bag of any conventional design.

The garbage can 12 has a bottom wall 16 and an outer wall 18 extending upwardly therefrom, and the outer wall 18 has a distal edge 20 with respect to the bottom wall 16 defining an opening 22 into the garbage can 12. The outer wall 18 has an inside surface 24 and an outside surface 26, and the outer wall 18 has a plurality of air holes 28 each extending through the outside surface 26 and the inside surface 24. In this way each of the plurality of air holes 28 passes air therethrough and into the interior of the garbage can 12. Each of the plurality of air holes 28 is positioned adjacent to the distal edge 20 of the outer wall 18. Moreover, each of the plurality of air holes 28 is spaced apart from each other and is distributed around an entire circumference of the garbage can 12.

A plurality of conduits 30 is each coupled to the garbage can 12 and each of the plurality of conduits 30 is positioned in an interior of the garbage can 12. Each of the plurality of conduits 30 is in fluid communication with a respective one of the air holes 28 in the garbage can 12. In this way each of the plurality of conduits 30 ventilates the interior of the garbage can 12 when the garbage bag 14 is removed from the garbage. Thus, a vacuum is inhibited from forming in the garbage can 12 when the garbage bag 14 is removed from the garbage can 12.

Each of the plurality of conduits 30 has a top end 32, a bottom end 34 and an exterior wall 36 extending therebetween, and each of the top end 32 and the bottom end 34 of each of the plurality of conduits 30 is open. The exterior wall 36 of each of the plurality of conduits 30 is coupled to the inside surface 24 of the outer wall 18 of the garbage can 12. The top end 32 of each of the plurality of conduits 30 is aligned with a respective one of the plurality of air holes 28 to pass air into the garbage can 12. Additionally, each of the plurality of conduits 30 is vertically oriented in the garbage can 12 having the bottom end 34 of each of the plurality of conduits 30 being spaced from the bottom wall 16 of the garbage can 12. In this way air can pass all the way to the bottom wall 16 of the garbage can 12 as the garbage bag 14 is being removed. As is most clearly shown in 4, each of the plurality of conduits 30 may have a bend 38 thereon that is positioned adjacent to the top end 32. The bend 38 defines a first portion 40 of the conduits 30 that is directed toward the respective air hole 28 and a second portion 42 of the conduits 30 that extends downwardly along the outer wall 18 of the garbage can 12.

In use, the garbage bag 14 is positioned in the garbage can 12 in the conventional manner for collection garbage. The air holes 28 and the conduits 30 ventilate the interior of the garbage can 12 when the garbage bag 14 is removed from the garbage can 12. In this way the air holes 28 inhibit a vacuum from forming in the garbage can 12 that would make it difficult to remove the garbage bag 14. A new garbage bag 14 is subsequently positioned in the garbage can 12 for collecting garbage.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An air flowing garbage can assembly being configured to ventilate air when a garbage bag is removed thereby inhibiting a vacuum from forming, said assembly comprising:

a garbage can having a garbage bag being removably positioned therein wherein said garbage can is configured to store garbage, said garbage can having a plurality of air holes each being integrated into said garbage can wherein said plurality of air holes is configured to pass air into an interior of said garbage can, wherein said garbage can has a bottom wall and an outer wall extending upwardly therefrom, said outer wall having a distal edge with respect to said bottom wall defining an opening into said garbage can, said outer wall having an inside surface and an outside surface, each of said plurality of air holes extending through said outside surface and said inside surface of said outer wall perpendicular to said bottom wall of said garbage can, a top portion of said outer wall being folded over and outwardly to define said distal edge, each of said plurality of holes being positioned adjacent to said distal edge of said outer wall and inset relative to said top portion of said outer wall; and a plurality of conduits, each of said conduits being coupled to said garbage can, each of said conduits being positioned in an interior of said garbage can, each of said conduits being in fluid communication with a respective one of said air holes in said garbage can wherein each of said conduits is configured to ventilate said interior of said garbage can when said garbage bag is removed from said garbage can thereby inhibiting a vacuum from forming in said garbage can, wherein each of said plurality of conduits has a top end, a bottom end and an exterior wall extending therebetween, said top end of each of said conduits being oriented to face laterally towards said respective one of said air holes in said garbage can, each of said top end and said bottom end of each of said plurality of conduits being open, a top portion of each said conduit adjacent to said top end being spaced from said inside surface of said outerwall, said exterior wall of each of said plurality of conduits extending downwardly from said top portion being coupled to said inside surface of said outer wall of said garbage can.

2. The assembly according to claim 1, wherein each of said plurality of air holes being spaced apart from each other and being distributed around a circumference of said garbage can.

3. The assembly according to claim 1, wherein said top end of each of said plurality of conduits is aligned with a respective one of said plurality of air holes wherein each of said plurality of conduits is configured to pass air into said garbage can, each of said plurality of conduits being vertically oriented in said garbage can having said bottom end of each of said plurality of conduits being spaced from said bottom wall of said garbage can.

4. An air flowing garbage can assembly being configured to ventilate air when a garbage ban is removed thereby inhibiting a vacuum from forming, said assembly comprising:

a garbage can having a garbage bag being removably positioned therein wherein said garbage can is configured to store garbage, said garbage can having plurality of air holes each being integrated into said garbage can wherein said plurality of air holes is configured to pass air into an interior of said garbage can, said garbage can having a bottom wall and an outer wall extending upwardly therefrom, said outer wall having a distal edge with respect to said bottom wall defining an opening into said garbage can, said outer wall having an inside surface and an outside surface, each of said plurality of air holes extending through said outside surface and said inside surface of said outer wall perpendicular to said bottom wall of said garbage can, a top portion of said outer wall being folded over and outwardly to define said distal edge, each of said plurality of holes being positioned adjacent to said distal edge of said outer wall and inset relative to said top portion of said outer wall, each of said plurality of air holes being spaced apart from each other and being distributed around a circumference of said garbage can; and a plurality of conduits, each of said plurality of conduits being coupled to said garbage can, each of said plurality of conduits being positioned in said interior of said garbage can, each of said plurality of conduits being in fluid communication with a respective one of said plurality of air holes in said garbage can wherein each of said plurality of conduits is configured to ventilate said interior of said garbage can when said garbage bag is removed from said garbage can thereby inhibiting a vacuum from forming in said garbage can, each of said plurality of conduits having a top end, a bottom end and an exterior wall extending therebetween, said top end of each of said conduits being oriented to face laterally towards said respective one of said air holes in said garbage can, each of said top end and said bottom end of each of said plurality of conduits being open, a top portion of each said conduit adjacent to said top end being spaced from said inside surface of said outer wall, said exterior wall of each of said plurality of conduits extending downwardly from said top portion being coupled to said inside surface of said outer wall of said garbage can, said top end of each of said plurality of conduits being aligned with a respective one of said plurality of air holes wherein each of said plurality of conduits is configured to pass air into said garbage can, each of said plurality of conduits being vertically oriented in said garbage can having said bottom end of each of said plurality of conduits being spaced from said bottom wall of said garbage can.

* * * * *